United States Patent [19]

Markum

[11] 4,264,804

[45] Apr. 28, 1981

[54] ELECTRIC HEATING ELEMENTS

[75] Inventor: Thomas R. Markum, Murfreesboro, Tenn.

[73] Assignee: Emerson Electric Co., St. Louis, Mo.

[21] Appl. No.: 98,966

[22] Filed: Nov. 30, 1979

[51] Int. Cl.[3] ..... H05B 3/06

[52] U.S. Cl. ..... 219/402; 219/10.55 R; 219/403

[58] Field of Search ..... 219/402, 403, 436, 458, 219/463–465, 467, 520, 532, 536, 537, 542, 546, 10.55 B, 10.55 R, 10.55 F, 355, 357, 351, 345, 447; 338/304, 306, 315–318

[56] References Cited

U.S. PATENT DOCUMENTS

| | | | |
|---|---|---|---|
| 2,961,520 | 11/1960 | Long | 219/10.55 F |
| 2,996,599 | 8/1961 | Powers | 219/436 |
| 3,048,688 | 8/1962 | Drugmand | 219/544 |
| 3,081,392 | 3/1963 | Warner | 219/10.55 B |
| 4,028,519 | 6/1977 | De Weese et al. | 219/10.55 R |

*Primary Examiner*—Arthur T. Grimley
*Assistant Examiner*—Bernard Roskoski
*Attorney, Agent, or Firm*—Michael Williams

[57] ABSTRACT

The invention relates to support legs for bake elements used in microwave ovens of the dual-purpose cavity oven type. The improved support leg comprises a threaded stud welded to the sheath of a conventional electric heating element, the stud having a threaded portion projecting from the sheath and adapted to receive an interiorly threaded ceramic sleeve. Ceramic cement is preferably used to insure against disassembly of the sleeve from the stud. The support leg may also be designated as a support standoff since the ceramic sleeve provides electrical clearance between the metal stud and the oven liner bottom to isolate and prevent any metal-to-metal contact.

8 Claims, 4 Drawing Figures

ELECTRIC HEATING ELEMENTS

BACKGROUND AND SUMMARY

Heretofore, metal support legs, of the type shown in U.S. Pat. No. 3,048,688 or U.S. Pat. No. 2,922,017, were used to support the metal sheath of a tubular bake element from the floor of a microwave oven. The leg shown in U.S. Pat. No. 3,048,688 is a V-shaped wire leg which is welded to the sheath, whereas the leg shown in U.S. Pat. No. 2,922,017 is a wire leg which is crimped on the sheath. Sheet metal legs, crimped onto the sheath, were also heretofore used.

However, the problem with these metal legs is that during microwave use, the metal-to-metal contact between the support leg and the floor of the oven created an arcing condition which interfered with the proper operation of the microwave energy.

The problem to overcome is the loose metal-to-metal contact between the oven floor and the adjoining part of the support leg. The problem could be solved by bolting or otherwise locking the leg to the floor of the oven, but this is objectional from a cleaning and replacement standpoint. Another way to solve the problem would be to insulate the floor of the oven to create a non-metallic surface, but this is expensive and might interfere with the microwave energy.

The support standoff or leg which is the subject matter of this invention provides a low-cost solution to the problem without the disadvantages mentioned above. In accordance with a preferred embodiment of the invention, a threaded metal stud is welded to the metal sheath of a conventional bake element, and a ceramic sleeve is threaded on the stud with its lower end adapted to engage the oven floor. Ceramic cement is preferably used to lock the sleeve to the stud.

DESCRIPTION OF THE DRAWING

In the drawing accompanying this specification and forming a part of this application, there is shown, for purpose of illustration, an embodiment which my invention may assume, and in this drawing.

DESCRIPTION OF THE PREFERRED EMBODIMENT

Figure 1:
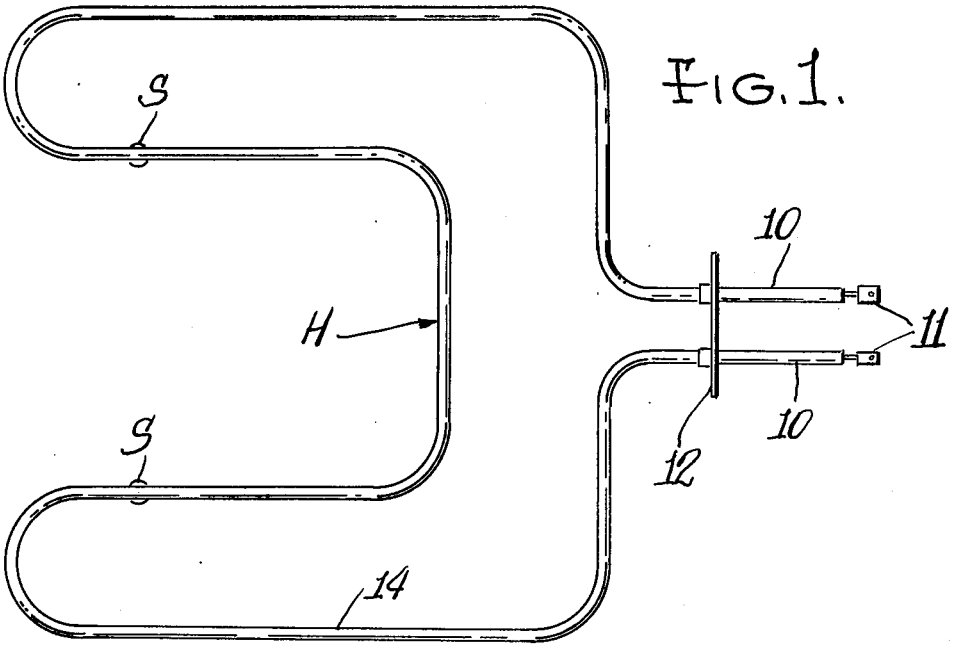
FIG. 1 is a plan view of a conventional bake element for use in a microwave oven, showing a preferred location of my improved support standoffs or legs.
Figure 2:
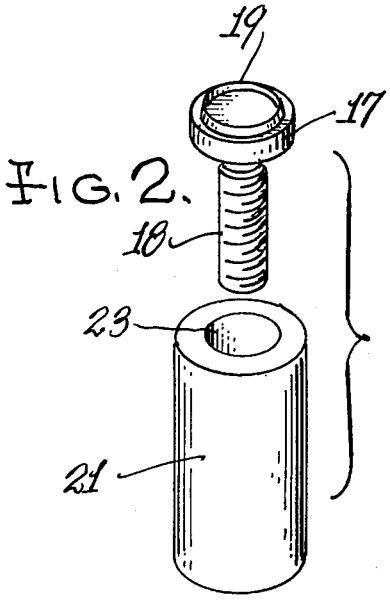
FIG. 2 is an enlarged perspective view of the two parts constituting the improved support leg, the parts being shown in separated relation.
Figure 3:
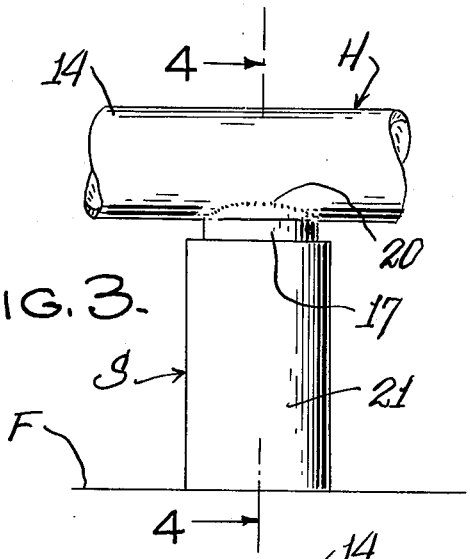
FIG. 3 is a fragmentary side elevational view of the support leg, attached to the sheath of the bake element.

The electric heating element H shown in FIG. 1 is of a type commonly used in the ovens of electric ranges and wherein it is arranged for disposition beneath and spaced from the pan or object to be heated in the oven. A frequent complaint about microwave ovens is that the foodstuff prepared in such oven, although well cooked, does not have a browned appearance. Therefore, conventional bake units were incorporated into microwave ovens and utilized to brown the foodstuff and make it look appetizing.

The usual bake element used in either conventional electrical ovens or microwave ovens is preferably configured as shown in FIG. 1 to provide a considerable heated area within the oven. The element has terminal legs 10—10 which extend through an opening in the rear wall of the oven (not shown) so that terminals 11—11 may be connected to a source of electrical energy. A mounting bracket 12 is staked securely crosswise of the terminal legs to close the opening in the oven rear wall and to mount the heating element on the latter.

Figure 4:
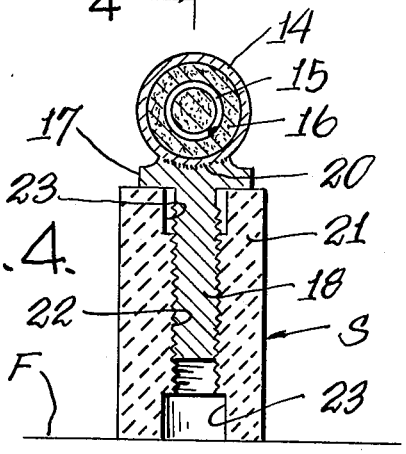
FIG. 4 is a sectional view corresponding to the line 4—4 of FIG. 3.

The bake element comprises a metal sheath 14 (see FIG. 4) in which a coiled resistance wire 15 is held in centered relation by highly-compacted granular refractory material 16. The element is so supported that it lies parallel and in closely-spaced relation to the metal floor F of the oven. The connection of the mounting bracket 12 with the rear wall of the oven provides support for the nonheating portion of the element, and support standoffs or legs S provide support for the active heating portion of the element.

Each support leg comprises a metal stud having a circular head 17 and a threaded shank 18. The stud is preferably formed of stainless steel and has an integral welding projection, such as the circular rib 19, V-shaped in cross section, extending from its upper surface. The stud and adjacent portion of the sheath are gripped in respective jaws of a resistance welding machine, and such jaws are moved together to press the rib 19 against the sheath while at the same time welding current is caused to flow between the jaws. The result is that the rib is fused to the sheath, as seen at 20 in FIG. 4, so that the stud becomes a structurally integral part of the sheath.

A sleeve 21 of rigid electric insulating material is connected to the stud for engagement with the oven floor F. The sleeve is preferably formed of ceramic material, such as Steatite #610, and of a length to be compatible with the desired space between the sheath and the oven floor.

The sleeve has a longitudinal opening which is formed with screw threads 22 interiorly of the opening and with slightly enlarged end portions 23 at opposite ends of the opening so that either end may be threaded on the stud. A ceramic cement of any commercially available type is injected into the sleeve opening prior to assembly of the sleeve on the stud. The ceramic cement, when set, adheres the sleeve to the stud to prevent their disassembly and the cement also acts as an electric insulator by filling the cavity 23 under the stud to prevent microwave arcing. In some cases, the cavities 23 may be omitted and the thread 22 formed to extend the full length of the sleeve.

I claim:

1. An electric heating element for browning food in a microwave oven having metal side and bottom walls, said heating element having an elongated tubular metal sheath, a resistance coil within said sheath and held spaced from the inner wall thereof by compacted granular refractory material, said heating element having a terminal portion at an end thereof and an active heating portion inwardly of such end, said terminal portion being connected to a side wall of said oven in cantilever fashion so that said active heating portion closely overlies the bottom wall of said oven, and a support for maintaining said active heating portion in predetermined spaced relation with respect to said bottom wall, free of arcing between said support and said bottom wall but without mechanical or fused connection therebetween, said support comprising a vertically-oriented metal stud having an upper end firmly connected to said sheath and extending downwardly therefrom in a direction transverse to the longitudinal axis of said sheath, and said support further comprising a member of rigid electrical insulating material firmly connected to the lower end of said stud and adapted to seat upon the bottom wall of said oven without any interconnection therewith.

2. The heating element according to claim 1 wherein said stud lower end is formed with screw threads, and said rigid insulating member has an opening with interior screw threads complementary to the threads on said stud, said member being firmly held to said stud by interengagement of its threads with the threads of said stud.

3. The heating element according to claim 2 wherein said stud has a head at its upper end, said head being firmly connected to said sheath.

4. The heating element according to claim 3 wherein said head has a projection weld rib extending from its upper surface, said rib being fused to said sheath by projecting welding.

5. The heating element according to claim 4 wherein said insulating member is a sleeve of rigid ceramic material, the opening in said sleeve being formed with internal screw threads and said sleeve being threaded on said stud.

6. The heating element according to claim 4 wherein the upper end of said sleeve abuts the under surface of said stud head and the lower end is engageable with said oven floor.

7. The heating element according to claim 5 wherein cured ceramic cement between the threads on said sleeve and stud locks the two together.

8. The heating element according to claim 7 wherein the end of said sleeve opening is formed with a circular enlargement to provide a cavity said ceramic cement filling the cavity to prevent microwave arcing.

* * * * *